US009412353B2

(12) United States Patent
Rhee

(10) Patent No.: US 9,412,353 B2
(45) Date of Patent: Aug. 9, 2016

(54) METHOD FOR CANCELLING NOISE AND ELECTRONIC DEVICE THEREOF

(71) Applicant: Samsung Electronics Co., Ltd., Gyeonggi-do (KR)

(72) Inventor: Min-Su Rhee, Jeollabuk-do (KR)

(73) Assignee: Samsung Electronics Co., Ltd (KR)

( * ) Notice: Subject to any disclaimer, the term of this patent is extended or adjusted under 35 U.S.C. 154(b) by 143 days.

(21) Appl. No.: 14/291,645

(22) Filed: May 30, 2014

(65) Prior Publication Data

US 2014/0369516 A1 Dec. 18, 2014

(30) Foreign Application Priority Data

Jun. 13, 2013 (KR) ..... 10-2013-0067809

(51) Int. Cl.
*G10K 11/00* (2006.01)
*G10K 11/178* (2006.01)

(52) U.S. Cl.
CPC ..... *G10K 11/002* (2013.01); *G10K 11/178* (2013.01)

(58) Field of Classification Search
CPC ..... G10K 11/002
See application file for complete search history.

(56) References Cited

U.S. PATENT DOCUMENTS

| | | | | |
|---|---|---|---|---|
| 6,101,258 | A * | 8/2000 | Killion | H04R 25/407 381/313 |
| 8,223,990 | B1 | 7/2012 | King | |
| 8,311,236 | B2 * | 11/2012 | Kanamori | H04R 3/005 348/207.99 |
| 8,654,212 | B2 * | 2/2014 | Kimura | G10L 21/0208 348/231.4 |
| 2003/0161484 | A1 * | 8/2003 | Kanamori | H04R 3/005 381/71.7 |
| 2004/0032509 | A1 | 2/2004 | Owens et al. | |
| 2010/0081487 | A1 | 4/2010 | Chen et al. | |
| 2012/0162471 | A1 | 6/2012 | Sekiya et al. | |
| 2012/0207324 | A1 * | 8/2012 | Harney | H04R 1/245 381/92 |

FOREIGN PATENT DOCUMENTS

| | | |
|---|---|---|
| JP | 2008-047203 | 2/2008 |
| KR | 1020100053889 | 5/2010 |
| KR | 1020110135343 | 12/2011 |
| KR | 1020120069538 | 6/2012 |

* cited by examiner

*Primary Examiner* — Paul Huber
(74) *Attorney, Agent, or Firm* — The Farrell Law Firm, P.C.

(57) ABSTRACT

An apparatus and method for cancelling a noise of an audio signal in an electronic device is provided. The method includes recording audio signals using a plurality of microphones and changing an audio signal which is introduced into a first microphone during a noise generation interval to an audio signal which is introduced into a second microphone, wherein the first microphone includes one or more microphones which are influenced by the noise among the plurality of microphones.

15 Claims, 11 Drawing Sheets

METHOD FOR CANCELLING NOISE AND ELECTRONIC DEVICE THEREOF

PRIORITY

The present application claims priority under 35 U.S.C. §119(a) to a Korean Patent Application filed in the Korean Intellectual Property Office on Jun. 13, 2013 and assigned Serial No. 10-2013-0067809, the entire disclosure of which is incorporated herein by reference.

BACKGROUND OF THE INVENTION

1. Field of the Invention

The present invention generally relates to a method for cancelling noise and an electronic device thereof.

2. Description of the Related Art

As information and communication technologies and semiconductor technologies have been developed, various electronic devices have been developed into multimedia devices, for providing various multimedia services. For example, the electronic devices may provide various multimedia services such as a broadcasting service, a wireless Internet service, a camera service, and a music play service.

The electronic devices may include a driving body to satisfy the desires of the user. For example, the electronic device may include a zoom lens to improve quality of the camera service.

When the electronic device includes the driving body, there may be a problem in that Quality of Service (QoS) is degraded due to noise resulting from the driving of the driving body. For example, zooming in or out an image during video capture degrades audio quality of moving pictures because a zoom noise is introduced into its microphone as a result of the driving of the zoom lens.

SUMMARY OF THE INVENTION

The present invention has been made to address at least the above problems and disadvantages, and to provide at least the advantages described below.

Accordingly, an aspect of the present invention is to provide an apparatus and method for cancelling noise generated by a driving body in an electronic device.

Another aspect of the present invention is to provide an apparatus and method for cancelling a zoom noise generated by a zoom lens in an electronic device.

Another aspect of the present invention is to provide an apparatus and method for cancelling a zoom noise generated by a zoom lens in an electronic device including a plurality of microphones.

Another aspect of the present invention is to provide an apparatus and method for cancelling a zoom noise which is introduced into at least one microphone in an electronic device including a plurality of microphones.

Another aspect of the present invention is to provide an apparatus and method for cancelling a zoom noise which is introduced into a first microphone using an audio signal which is introduced into a second microphone in an electronic device including a plurality of microphones.

In accordance with an aspect of the present invention, a method of cancelling a noise in an electronic device is provided. The method includes recording audio signals using a plurality of microphones; and changing a first section of an audio signal which is introduced into a first microphone during a noise generation to a second section of an audio signal which is introduced into a second microphone, wherein the first section of the audio signal includes a noise above a predetermined level.

In accordance with another aspect of the present invention, an electronic device is provided. The electronic device includes a plurality of microphones; and a processor for recording audio signals using the plurality of microphones, changing a first section of an audio signal which is introduced into a first microphone among the plurality of microphones to a second section of an audio signal which is introduced into a second microphone among the plurality of microphones, wherein the first section of the audio signal includes a noise above a predetermined level.

BRIEF DESCRIPTION OF THE DRAWINGS

The above and other aspects, features and advantages of certain embodiments of the present invention will be more apparent from the following detailed description taken in conjunction with the accompanying drawings, in which.

DETAILED DESCRIPTION OF EMBODIMENTS OF THE PRESENT INVENTION

Figure 1A:
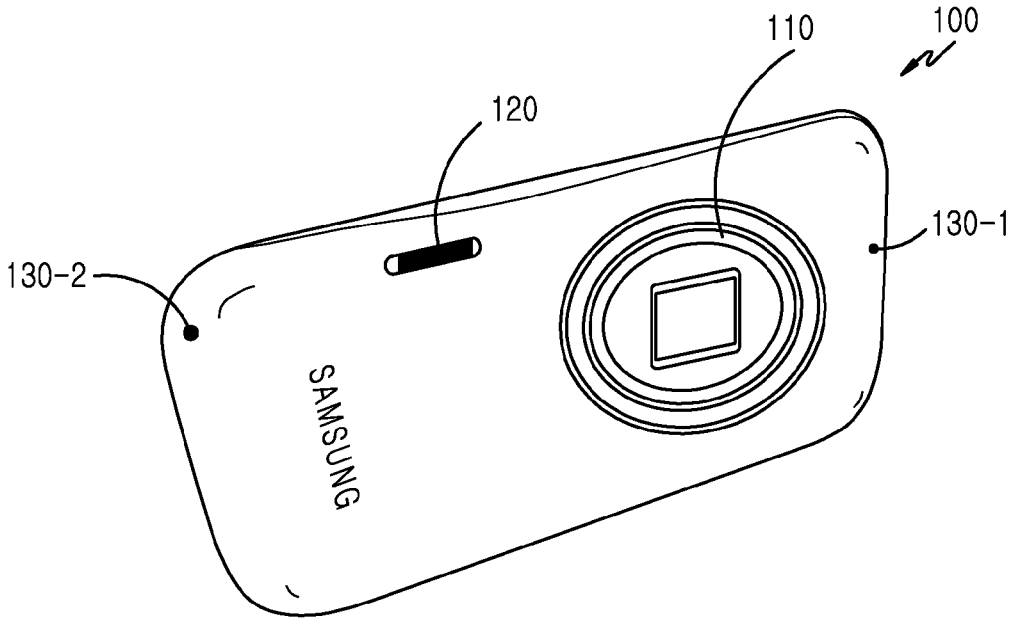
FIGS. 1A and 1B illustrate the appearance of an electronic device according to one embodiment of the present invention.

The following description with reference to the accompanying drawings is provided to assist in a comprehensive understanding of embodiments of the invention as defined by the claims and their equivalents. It includes various specific details to assist in that understanding but these are to be regarded as mere examples. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to their dictionary meanings, but are merely used to enable a clear and consistent understanding of the invention. Accordingly, it should be apparent to those skilled in the art that the following description of embodiments of the present invention is provided for illustration purposes only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Hereinafter, a description will be given for an apparatus and method for cancelling a noise which is introduced together with an audio signal by the driving of a driving body in an electronic device.

The electronic device may be any one of apparatuses, such as a portable electronic device, a portable terminal, a mobile terminal, a mobile communication terminal, a mobile pad, a media player, a Personal Digital Assistant (PDA), a Personal Computer (PC), a desktop computer, a laptop computer, a smart phone, a netbook computer, a TeleVision (TV), a Mobile Internet Device (MID), an Ultra Mobile PC (UMPC), a tablet PC, a navigation device, a smart TV, a watch, a digital camera, and a Moving Picture Experts Group (MPEG) layer 3 (MP3) player, each of which may include a plurality of microphones and perform a stereo recording. Also, the electronic device may be a certain electronic device in which functions of two or more apparatuses are combined among the apparatuses.

Hereinafter, the driving body according to one embodiment of the present invention may include a component which may be moved (driven) among modules included in the electronic device, such as a zoom lens and a vibration motor. Hereinafter, it is assumed that the electronic device cancels a zoom noise by a zoom lens.

Figure 1B:
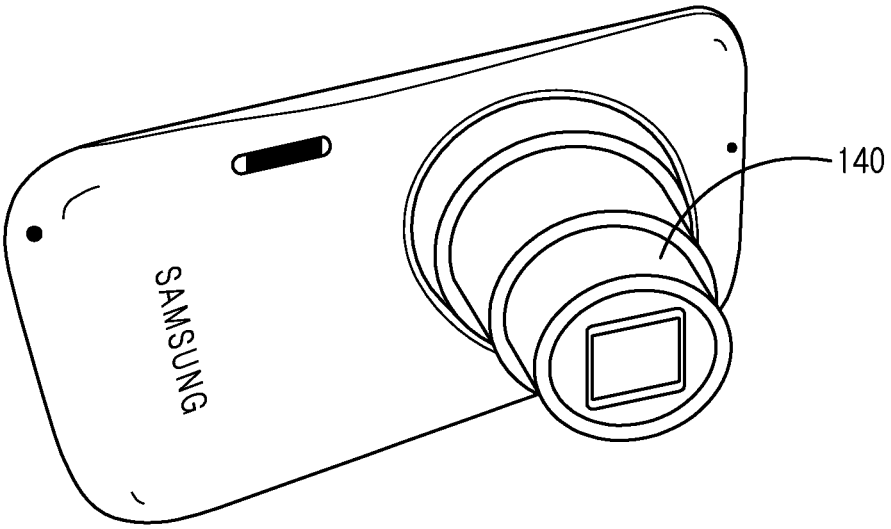

FIGS. 1A and 1B illustrate the appearance of an electronic device according to one embodiment of the present invention.

As shown in FIG. 1A, the electronic device by 100 includes a zoom lens 110 on its front surface and a light emitting part 120 for photographing an object in a dark place in adjacent to of the zoom lens 110. Also, the electronic device 100 includes a plurality of microphones 130-1 and 130-2 for performing a stereo recording in both side surfaces or in both sides of the front surface. Herein, the stereo recording may indicate a method of recording peripheral audio signals using the plurality of microphones 130-1 and 130-2 to make stereo sound effects in a video or sound recording.

The zoom lens 110 includes a plurality of lenses to photograph an object from a wide angle to a telephoto angle because its focal length is not fixed. The electronic device 100 may adjust distances of the lenses included in the zoom lens 110 and may change its focal length to photograph the object through the zoom lens 110. For example, sensing generation of a zooming-in event through a zoom control button or a zoom icon, the electronic device 100 may change the focal length to photograph the object using the zoom lens 110 by driving its zoom motor and, as shown in FIG. 1B, adjusting distances of lenses 140 included in the zoom lens 110.

As described above, because the electronic device 100 changes a focal length of the zoom lens 110 using the zoom motor, a zoom noise by the zoom motor may be introduced into the first microphone 130-1 adjacent to the zoom motor. Accordingly, the electronic device 100 must cancel the zoom noise which is introduced into the first microphone 130-1 during an interval where the zoom noise is generated. For example, the electronic device 100 may copy an audio signal, which is introduced into the second microphone 130-2 during the interval where the zoom noise is generated, into an audio signal which is introduced into the first microphone 130-1. The electronic device 100 may inactivate the first microphone 103-1 during the interval where the zoom noise is generated.

Figure 2:
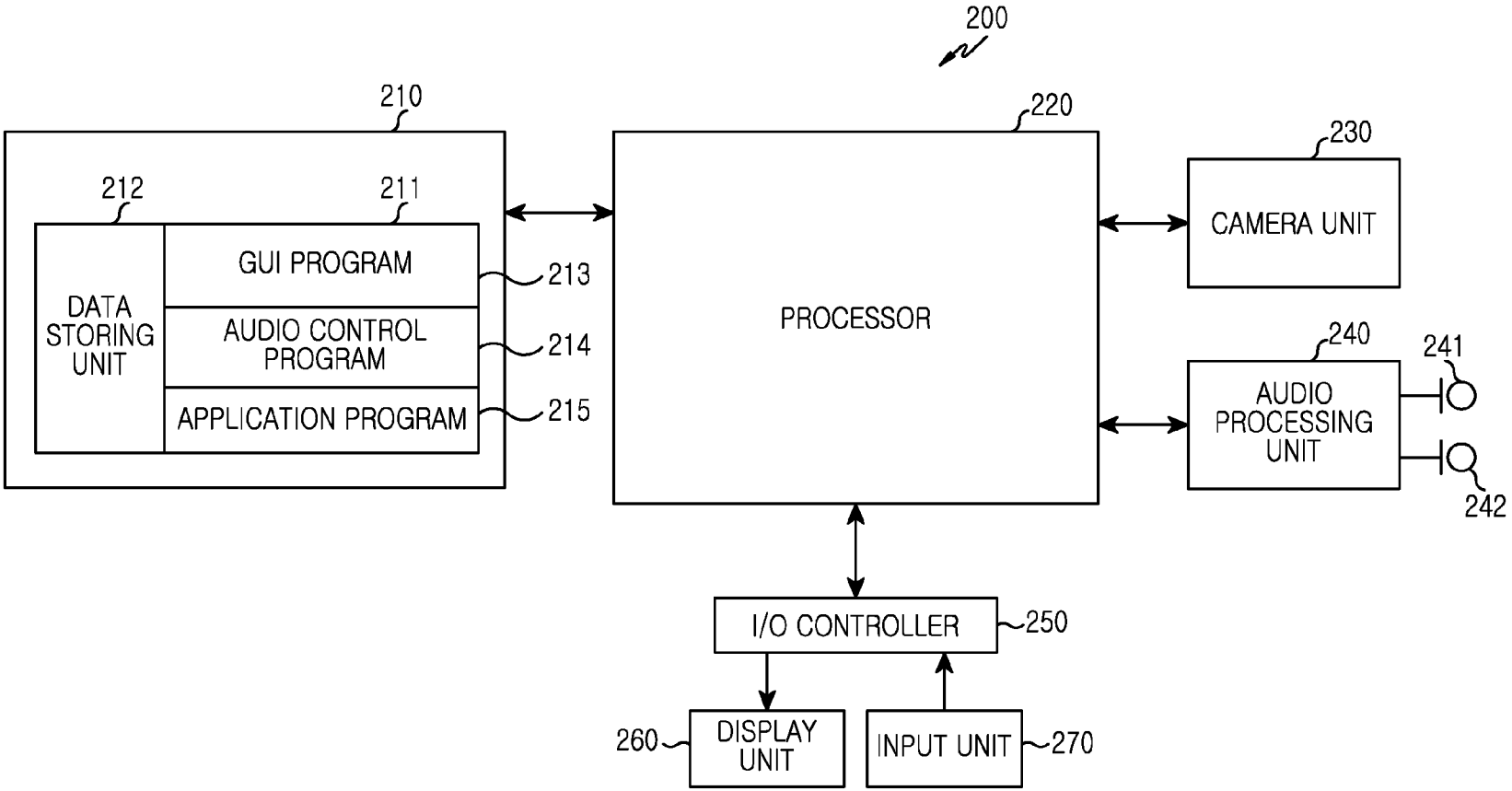
FIG. 2 is a block diagram illustrating a configuration of an electronic device according to one embodiment of the present invention.

FIG. 2 is a block diagram illustrating configuration of an electronic device according to one embodiment of the present invention.

Hereinafter, it may be assumed that a zoom noise is introduced into a first microphone 241 among a plurality of microphones 241 and 242 included in the electronic device 200.

As shown in FIG. 2, the electronic device 200 includes a memory 210, a processor 220, a camera unit 230, an audio processing unit 240, an Input/Output (I/O) controller 250, a display unit 260, and an input unit 270. Herein, the memory 210 and the processor 220 may be a plurality of memories and processors, respectively.

The memory 210 includes a data storing unit 212 for storing data generated by the driving of the electronic device 200 and a program storing unit 211 for storing one or more programs for controlling operations of the electronic device 200.

The data storing unit 212 stores images acquired through the camera unit 230 through a stereo recording and stereo audio signals acquired through the microphones 241 and 242.

The program storing unit 211 includes a Graphic User Interface (GUI) program 213, an audio control program 214, and at least one application program 215. Herein, the programs included in the program storing unit 211 may be expressed as a set of instructions.

The GUI program 213 includes at least one software component for providing a UI as graphics on the display unit 260. For one example, the GUI program 213 may control the display unit 260 to display information about an application program executed by the processor 220. For example, the GUI program 213 may control the display unit 260 to display an image acquired through the camera unit 230.

The audio control program 214 includes at least one software component for performing a stereo recording through the microphones 241 and 242. Herein, the audio control program 214 may cancel a zoom noise which is introduced into at least one of the microphones 241 and 242. For example, the audio control program 214 may cancel a zoom noise which is introduced into the first microphone 241 by copying an audio signal, which is introduced into the second microphone 242 during a noise generation interval in a stereo recording, into an audio signal which is introduced into the first microphone 241. The audio control program 214 may inactivate the first microphone 241 during the noise generation interval. The noise generation interval may include an interval where a zoom noise is generated by a zoom operation of a zoom lens. Therefore, the audio control program 214 recognizes a zoom operation interval of the zoom lens as a noise generation interval.

The audio control program 214 determines whether to cancel a zoom noise in consideration of a volume level of each of audio signals which are introduced into one or more of the microphones 241 and 242 during the noise generation interval in the stereo recording. For one example, using one microphone, when an average volume level of audio signals which are introduced into the first microphone 241 during the noise generation interval is greater than a reference level, the audio control program 214 determines that a user of the electronic device 100 may not recognize a zoom noise by the audio signal and determines that the zoom noise is not cancelled. On the other hand, when the average volume level of the audio signals which are introduced into the first microphone 241 during the noise generation interval is less than or equal to the reference level, the audio control program 214 determines that the user may recognize a zoom noise and determines that the zoom noise is cancelled. Herein, the reference level may be determined based on the volume level of the zoom noise.

For another example, using both microphones, when an average volume level of audio signals which are introduced into the microphones 241 and 242 during the noise generation interval is greater than the reference level, the audio control program 214 determines that the user may not recognize a zoom noise by the audio signals and determines that the zoom noise is not cancelled. On the other hand, when the average volume level of the audio signals which are introduced into the microphones 241 and 242 during the noise generation interval is less than or equal to the reference level, the audio control program 214 determines that the user may recognize a zoom noise by the audio signals and determines that the zoom noise is cancelled.

For another example, when an interval, where a volume level of an audio signal which is introduced into the first microphone 241 during the noise generation interval is greater than a reference level, is greater than a reference interval, the audio control program 214 determines that the user may not recognize a zoom noise by the audio signal and determines that the zoom noise is not cancelled. On the other hand, when the interval, where the volume level of the audio signal which is introduced into the first microphone 241 during the noise generation interval is greater than the reference level, is less than or equal to the reference interval, the audio control program 214 determines that the user may recognize a zoom noise and determines that the zoom noise is cancelled.

The application program 215 includes a software component for at least one application program installed in the electronic device 200.

The processor 220 performs a control operation to provide a variety of multimedia services using at least one program. Herein, the processor 220 performs a control operation to execute at least one program stored in the memory 210 and provides a service according to the corresponding program. For example, the processor 220 executes the audio control program 214 stored in the program storing unit 211 and cancels a zoom noise which is introduced into at least one of the microphones 241 and 242. For example, the processor 220 may cancel a zoom noise which is introduced into the first microphone 241 by copying an audio signal, which is introduced into the second microphone 242 during a noise generation interval in a stereo recording, into an audio signal which is introduced into the first microphone 241. Herein, the processor 220 may inactivate the first microphone 241 during the noise generation interval.

The processor 220 determines whether to cancel a zoom noise in consideration of a volume level of each of audio signals which are introduced into the one or more microphones 241 and 242 during the noise generation interval in the stereo recording. For example, the processor 220 determines whether to cancel a zoom noise in consideration of an average volume level of the audio signals which are introduced into the one or more microphones 241 and 242 during the noise generation interval or in consideration of information about an interval where a volume level of an audio signal during the noise generation interval is greater than a reference level.

The camera unit 230 provides collection images acquired by photographing an object to the processor 220. For example, the camera unit 230 includes a zoom lens for converting an optical signal into an electric signal and an Image Signal Processor (ISP) for converting an analog image signal into a digital image signal.

The audio processing unit 240 collects peripheral audio signals through the microphones 241 and 242 and provides the collected audio signals to the processor 220. Although it is not shown in FIG. 2, the audio processing unit 240 may transmit an audio signal to the outside through a speaker.

The I/O controller 250 provides an interface between I/O devices, such as the display device 260 and the input unit 270, and the processor 220.

The display unit 260 displays state information of the electronic device 200, characters input by the user, moving pictures, still pictures, etc. For example, the display unit 260 may display an image provided from the camera unit 230.

The input unit 270 provides input data generated by selection of the user to the processor 220 through the I/O controller 250. Herein, the input unit 270 includes at least one hardware button, a touch pad for sensing touch information, a separate input device, etc.

Although it is not shown in FIG. 2, the electronic device 200 may further include a communication system for performing a communication function for voice and data communication. Herein, the communication system may be classified into a plurality of communication sub-modules which support different communication networks. For example, the communication network may include, but is not limited to, one or more of a Global System for Mobile (GSM) communication network, an Enhanced Data GSM Environment (EDGE) network, a Code Division Multiple Access (CDMA) network, a W-CDMA network, a Long Term Evolution (LTE) network, an Orthogonal Frequency Division Multiple Access (OFDMA) network, a wireless Local Area Network (LAN), a Bluetooth network, and a Near Field Communication (NFC) network.

In one embodiment of the present invention, the processor 220 executes software components stored in the program storing unit 211 in one module and cancels the zoom noise which is introduced into the one or more microphones 241 and 242.

Figure 3:
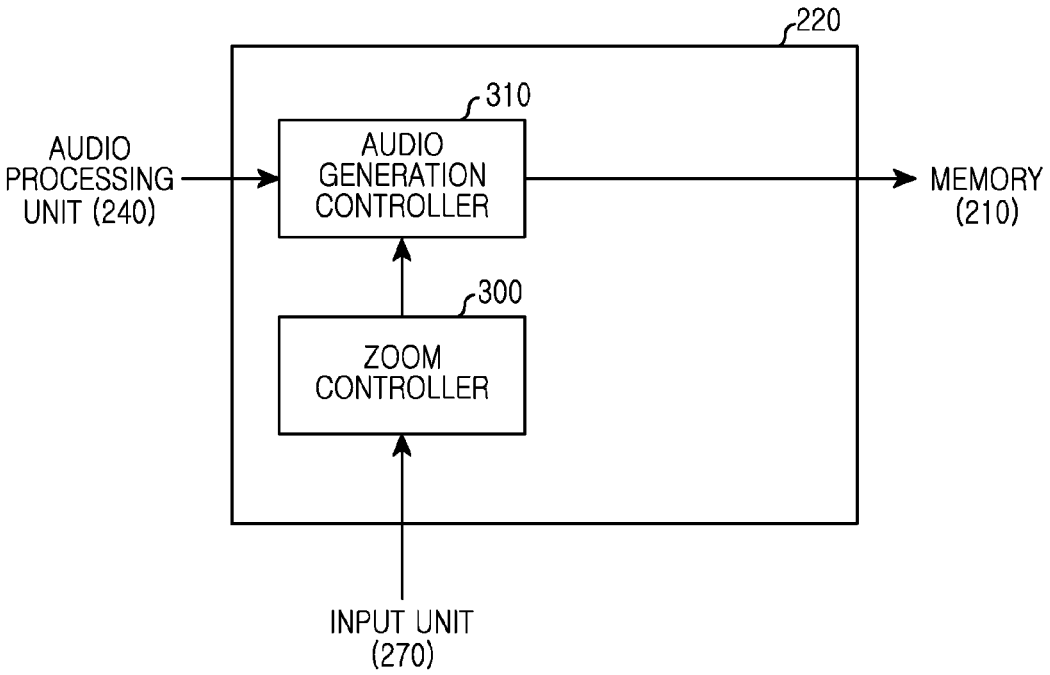
FIG. 3 is a block diagram illustrating a detailed configuration of a processor according to one embodiment of the present invention.

In another embodiment of the present invention, as shown in FIG. 3, the processor 220 may include components, for canceling a zoom noise which is introduced into the one or more microphones 241 and 242, as separate modules.

FIG. 3 is a block diagram illustrating a detailed configuration of a processor according to one embodiment of the present disclosure.

As shown in FIGS. 2 and 3, the processor 220 includes a zoom controller 300 and an audio generation controller 310.

The zoom controller 300 adjusts a focal length of a zoom lens according to a zoom event. For one example, upon receiving a zoom control command through a zoom control button of the input unit 270, the zoom controller 300 adjusts a focal length of the zoom lens using a zoom motor according to the zoom control command. For another example, upon sensing selection of a zoom icon through a touch pad of the input unit 270, the zoom controller 300 adjusts a focal length of the zoom lens using the zoom motor according to selection information of the zoom icon.

The audio generation controller 310 executes the audio control program 214 stored in the program storing unit 211 and performs a stereo recording through the plurality of microphones 241 and 242. Herein, the audio generation controller 310 cancels a zoom noise which is introduced into at least one of the microphones 241 and 242. For example, the audio generation controller 310 may cancel a zoom noise which is introduced into the first microphone 241 by copying an audio signal, which is introduced into the second microphone 242 during a noise generation interval in a stereo recording, into an audio signal which is introduced into the first microphone 241. Herein, the audio generation controller 310 may inactivate the microphone 241 during the noise generation interval, and the audio generation controller 310 recognizes an interval where the zoom lens performs a zoom operation by the zoom controller 300 as the noise generation interval.

The audio generation controller 310 determines whether to cancel a zoom noise in consideration of a volume level of each of audio signals which are introduced into the one or more microphones 241 and 242 during the noise generation interval in the stereo recording. The audio generation controller 310 may determine whether to cancel a zoom noise in consideration of an average volume level of audio signals which are introduced into the one or more microphones 241 and 242 during the noise generation interval or in consideration of information about an interval where a volume level of an audio signal during the noise generation interval is greater than a reference level.

Figure 4:
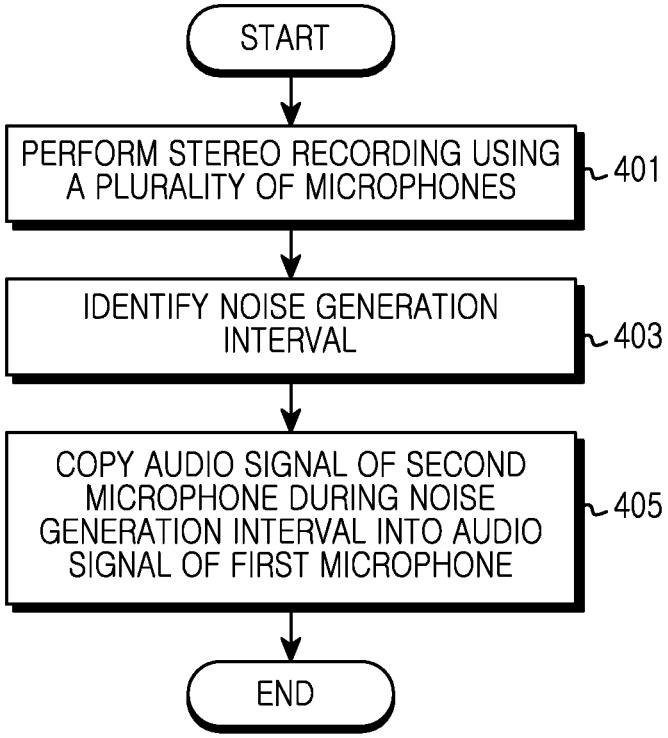
FIG. 4 is a flowchart illustrating a process of cancelling a noise in an electronic device according to one embodiment of the present invention.

FIG. 4 is a flowchart illustrating a process of cancelling a noise in an electronic device according to one embodiment of the present invention.

Figure 9A:
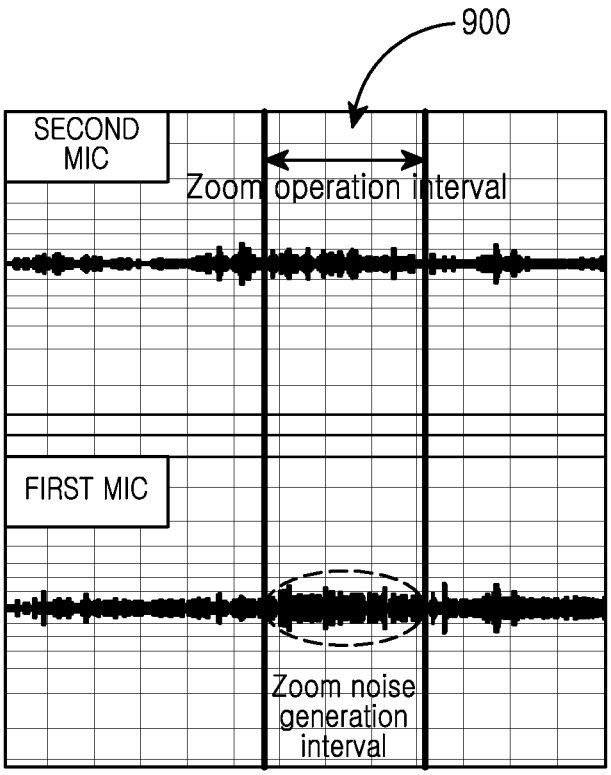
FIGS. 9A and 9B are waveform charts of an audio signal illustrating a process of cancelling a noise in an electronic device according to one embodiment of the present invention.
Figure 9B:
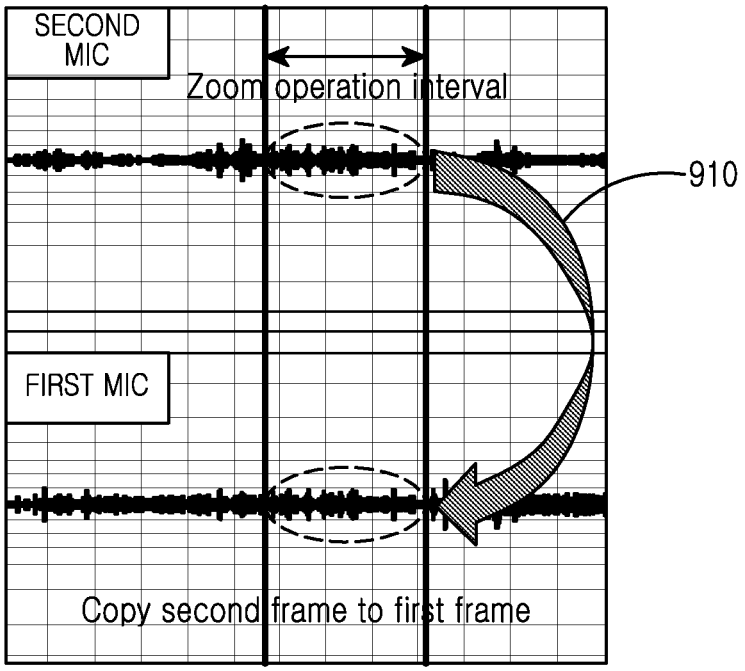

Hereinafter, a description will be given for a process of cancelling a zoom noise with reference to waveforms of audio signals shown in FIGS. 9A and 9B.

Referring to FIGS. 1A and 4, the electronic device performs a stereo recording using a plurality of microphones in step 401. For example, the electronic device 100 shown in FIG. 1A performs a stereo recording through microphones 130-1 and 130-2 which are located in both side surfaces or both sides of its front surface. Herein, audio signals recorded through the first microphone 130-1 and the second microphone 130-2 may be displayed, as shown in FIG. 9A, as waveforms.

While the stereo recording is performed, the electronic device proceeds to step 403 and identifies a noise generation interval. For example, the electronic device 100 determines, as shown in FIG. 9A, an interval 900 where the zoom lens 110 performs a zoom operation during the stereo recording as a noise generation interval.

After determining the noise generation interval, the electronic device proceeds to step 405 and cancels a zoom noise by copying an audio signal which is introduced into the second microphone during the noise generation interval into an audio signal of the first microphone which is influenced by the zoom noise. For example, the electronic device 100 changes, as shown in FIG. 9B, an audio signal which is introduced into the first microphone 130-1 which is influenced by a zoom noise during the noise generation interval 900 to an audio signal which is introduced into the second microphone 130-2 to cancel the zoom noise (see reference number 910).

As described above, the electronic device cancels the zoom noise by copying the audio signal which is introduced into the second microphone during the noise generation interval into the audio signal of the first microphone which is influenced by the zoom noise. Therefore, the electronic device inactivates the first microphone 130-1 during the noise generation interval in the stereo recording.

Figure 5:
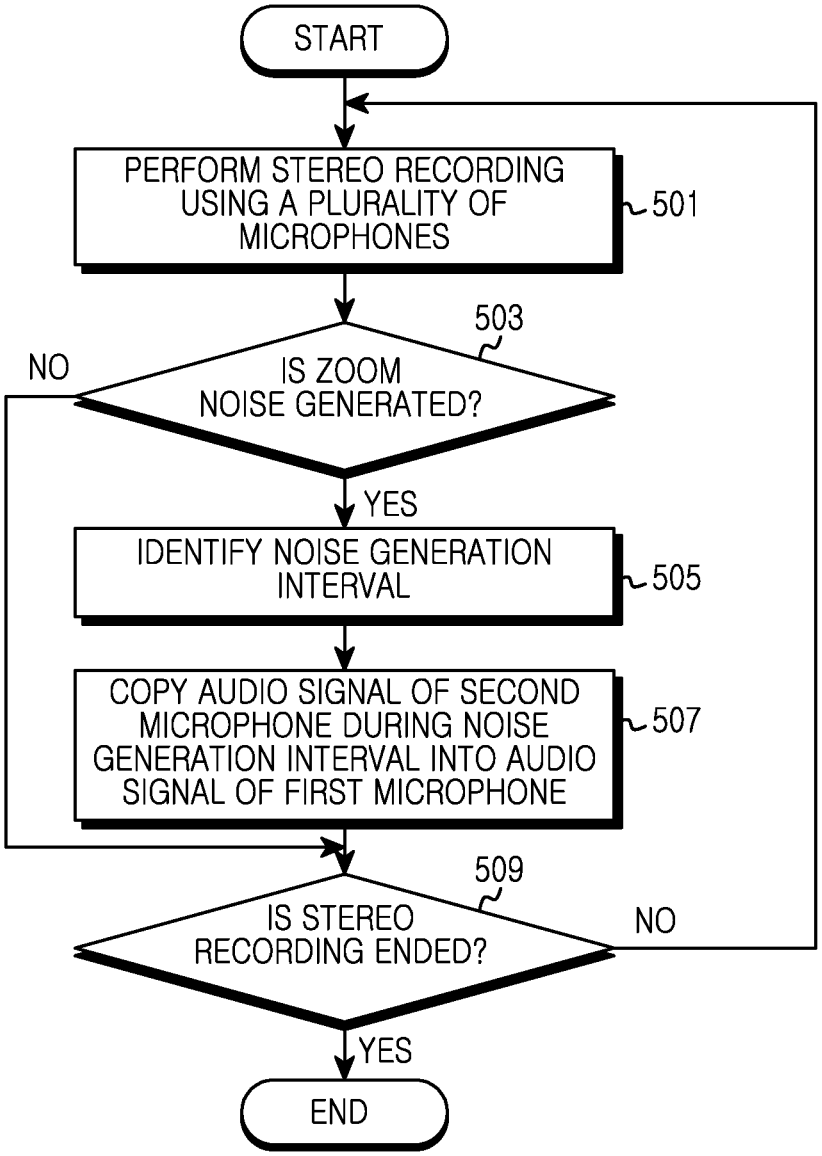
FIG. 5 is a flowchart illustrating a process of cancelling a zoom noise in an electronic device according to one embodiment of the present invention.

FIG. 5 is a flowchart illustrating a process of cancelling a zoom noise in an electronic device according to one embodiment of the present invention.

Referring to FIGS. 1A and 5, the electronic device performs a stereo recording using a plurality of microphones in step 501. For example, the electronic device 100 shown in FIG. 1A performs a stereo recording through microphones 130-1 and 130-2 which are located in both side surfaces or both sides of its front surface.

While the stereo recording is performed, the electronic device proceeds to step 503 and determines whether a zoom noise is generated. For example, the electronic device 100 determines whether a zoom event for the zoom lens 110 is generated through a zoom control button or a zoom icon.

When the zoom noise is not generated, the electronic device proceeds to step 509 and determines whether the stereo recording is ended.

When the zoom noise is generated, the electronic device proceeds to step 505 and identifies a noise generation interval. For example, the electronic device 100 determines an interval where the zoom lens 110 performs a zoom operation during the stereo recording as the noise generation interval. When the zoom noise is generated, the electronic device 100 inactivates the first microphone 130-1 which is influenced by a noise until the zoom noise is ended. That is, the electronic device 100 may block an audio signal from being introduced into the first microphone 130-1 during the noise generation interval.

After determining the noise generation interval, the electronic device proceeds to step 507 and cancels a zoom noise by copying an audio signal which is introduced into the second microphone during the noise generation interval into an audio signal of the first microphone which is influenced by the zoom noise. For example, the electronic device 100 may change, as shown in FIG. 9B, an audio signal which is introduced into the first microphone 130-1 which is influenced by a zoom noise during the noise generation interval 900 to an audio signal which is introduced into the second microphone 130-2 to cancel the zoom noise (see reference number 910).

Thereafter, the electronic device proceeds to step 509 and determines whether the stereo recording is ended.

When the stereo recording is not ended, the electronic device returns to step 501 and performs a stereo recording using the plurality of microphones.

When the stereo recording is ended, the electronic device ends the procedure of FIG. 5.

Figure 6:
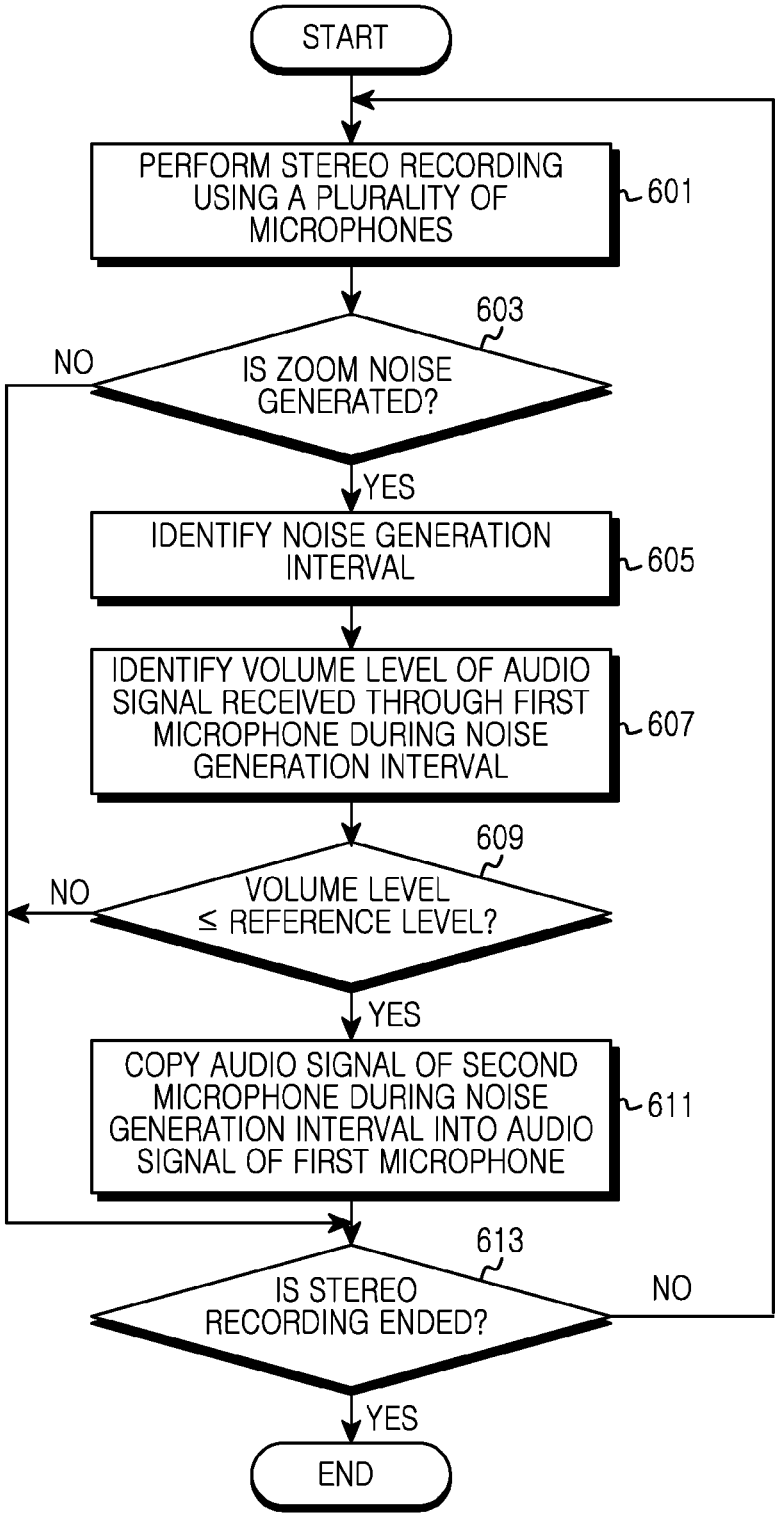
FIG. 6 is a flowchart illustrating a process of cancelling a zoom noise in an electronic device according to another embodiment of the present invention e.

FIG. 6 is a flowchart illustrating a process of cancelling a zoom noise in an electronic device according to another embodiment of the present invention.

Referring to FIGS. 1A and 6, the electronic device performs a stereo recording using a plurality of microphones in step 601. For example, the electronic device 100 shown in FIG. 1A performs a stereo recording through microphones 130-1 and 130-2 which are located in both side surfaces or both sides of its front surface.

While the stereo recording is performed, the electronic device proceeds to step 603 and determines whether a zoom noise is generated. For example, the electronic device 100 determines whether a zoom event for the zoom lens 110 is generated through a zoom control button or a zoom icon.

When the zoom noise is not generated, the electronic device proceeds to step 613 and determines whether the stereo recording is ended.

When the zoom noise is generated, the electronic device proceeds to step 605 and identifies a noise generation interval. For example, the electronic device 100 determines an interval where the zoom lens 110 performs a zoom operation during the stereo recording as the noise generation interval.

After determining the noise generation interval, the electronic device proceeds to step 607 and identifies a volume level of an audio signal which is introduced into the first microphone which is influenced by the zoom noise during the noise generation interval. For example, the electronic device 100 identifies an average volume level of audio signals which are introduced into the first microphone 130-1 during the noise generation interval.

Thereafter, the electronic device proceeds to step 609 and compares the volume level of the audio signal which is introduced into the first microphone with a reference level by determining whether the volume level of the audio signal which is introduced into the first microphone is less than or equal to the reference level. For example, the electronic device 100 compares an average volume level of audio signals which are introduced into the first microphone 130-1 during the noise generation interval with a reference level.

When the volume level of the audio signal which is introduced into the first microphone is greater than the reference level, the electronic device determines that its user may not recognize a zoom noise by the audio signal. Accordingly, the electronic device proceeds to step 613 and determines whether the stereo recording is ended.

When the volume level of the audio signal which is introduced into the first microphone is less than or equal to the reference level, the electronic device proceeds to step 611 and cancels a zoom noise by copying an audio signal which is introduced into the second microphone during the noise generation interval into an audio signal of the first microphone which is influenced by the zoom noise. For example, the electronic device 100 may change, as shown in FIG. 9B, an audio signal which is introduced into the first microphone 130-1 which is influenced by a zoom noise during the noise generation interval 900 to an audio signal which is introduced into the second microphone 130-2 to cancel the zoom noise (see reference number 910).

Thereafter, the electronic device proceeds to step 613 and determines whether the stereo recording is ended.

When the stereo recording is not ended, the electronic device returns to step 601 and performs a stereo recording using the plurality of microphones.

When the stereo recording is ended, the electronic device ends the procedure of FIG. 6.

In the above-described embodiment of the present invention, the electronic device cancels the zoom noise selectively in consideration of the volume level of the audio signal which is introduced into the first microphone which is influenced by the zoom noise.

In another embodiment of the present invention, the electronic device cancels a zoom noise selectively in consideration of volume levels of audio signals which are introduced into the plurality of microphones.

In the above-described embodiment of the present invention, the electronic device cancels the zoom noise selectively by comparing the volume level of the audio signal which is introduced into the first microphone which is influenced by the zoom noise with the reference level.

In another embodiment of the present invention, the electronic device cancels a zoom noise selectively in consideration of information about an interval where the volume level of the audio signal which is introduced into the first microphone during the noise generation interval is greater than the reference level. For example, when an interval, where the volume level of the audio signal which is introduced into the first microphone during the noise generation interval is greater than the reference level, is greater than a reference interval, the electronic device determines that the user may not recognize a zoom noise by the audio signal and determine that the zoom noise is not cancelled. On the other hand, when the interval, where the volume level of the audio signal which is introduced into the first microphone during the noise generation interval is greater than the reference level, is less than or equal to the reference interval, the electronic device determines that the user may recognize a zoom noise by the audio signal and determines that the zoom noise is cancelled.

Figure 7:
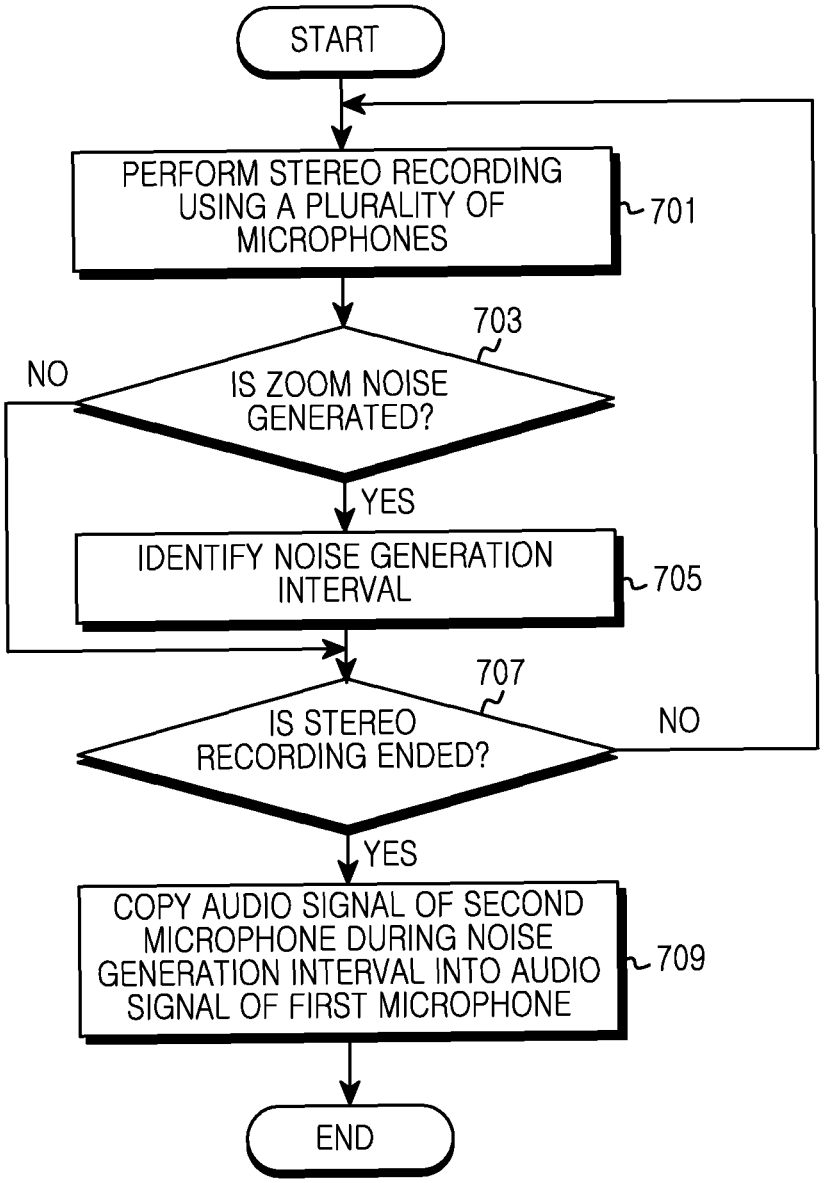
FIG. 7 is a flowchart illustrating a process of cancelling a zoom noise in an electronic device according to another embodiment of the present invention.

FIG. 7 is a flowchart illustrating a process of cancelling a zoom noise in an electronic device according to another embodiment of the present.

Referring to FIGS. 1A and 7, the electronic device performs a stereo recording using a plurality of microphones in step 701. For example, the electronic device 100 shown in FIG. 1A performs a stereo recording through microphones 130-1 and 130-2 which are located in both side surfaces or both sides of its front surface.

While the stereo recording is performed, the electronic device proceeds to step 703 and determines whether a zoom noise is generated. For example, the electronic device 100 determines whether a zoom event for the zoom lens 110 is generated through a zoom control button or a zoom icon.

When the zoom noise is not generated, the electronic device proceeds to step 707 and determines whether the stereo recording is ended.

When the zoom noise is generated, the electronic device proceeds to step 705 and identifies a noise generation interval. For example, the electronic device 100 determines an interval where the zoom lens 110 performs a zoom operation during the stereo recording as the noise generation interval. When the zoom noise is generated, the electronic device 100 inactivates the first microphone 130-1 which is influenced by a noise until the zoom noise is ended. That is, the electronic device 100 blocks an audio signal from being introduced into the first microphone 130-1 during the noise generation interval.

Thereafter, the electronic device proceeds to step 707 and determines whether the stereo recording is ended.

When the stereo recording is not ended, the electronic device returns to step 701 and performs a stereo recording using the plurality of microphones.

When the stereo recording is ended, the electronic device proceeds to step 709 and cancels a zoom noise by copying an audio signal which is introduced into the second microphone during one or more noise generation intervals generated in the stereo recording into an audio signal of the first microphone which is influenced by the zoom noise. For example, the electronic device 100 may change, as shown in FIG. 9B, an audio signal which is introduced into the first microphone 130-1 which is influenced by a zoom noise during the noise generation interval 900 to an audio signal which is introduced into the second microphone 130-2 to cancel the zoom noise (see reference number 910).

Thereafter, the electronic device ends the procedure of FIG. 7.

Figure 8:
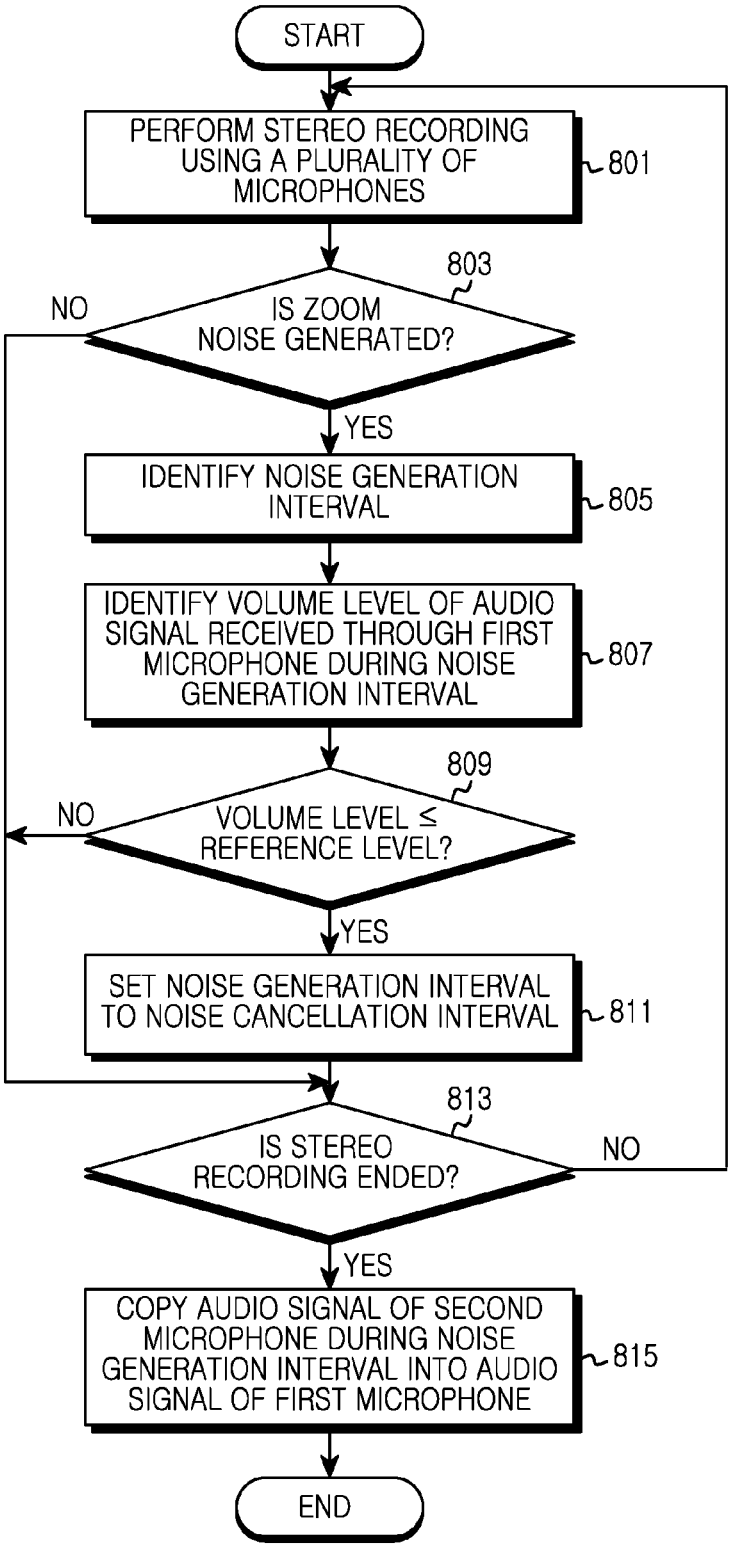
FIG. 8 is a flowchart illustrating a process of cancelling a zoom noise in an electronic device according to another embodiment of the present invention.

FIG. 8 is a flowchart illustrating a process of cancelling a zoom noise in an electronic device according to another embodiment of the present invention.

Referring to FIGS. 1A and 8, the electronic device performs a stereo recording using a plurality of microphones in step 801. For example, the electronic device 100 shown in FIG. 1A performs a stereo recording through microphones 130-1 and 130-2 which are located in both side surfaces or both sides of its front surface.

While the stereo recording is performed, the electronic device proceeds to step 803 and determines whether a zoom noise is generated. For example, the electronic device 100 determines whether a zoom event for the zoom lens 110 is generated through a zoom control button or a zoom icon.

When the zoom noise is not generated, the electronic device proceeds to step 813 and determines whether the stereo recording is ended.

When the zoom noise is generated, the electronic device proceeds to step 805 and identifies a noise generation interval. For example, the electronic device 100 determines an interval where the zoom lens 110 performs a zoom operation during the stereo recording as the noise generation interval.

After determining the noise generation interval, the electronic device proceeds to step 807 and identifies a volume level of an audio signal which is introduced into the first microphone which is influenced by the zoom noise during the noise generation interval. For example, the electronic device 100 identifies an average volume level of audio signals which are introduced into the first microphone 130-1 during the noise generation interval.

Thereafter, the electronic device proceeds to step 809 and compares the volume level of the audio signal which is introduced into the first microphone with a reference level by determining whether the volume level of the audio signal which is introduced into the first microphone during the noise generation interval is less than or equal to the reference level. For example, the electronic device 100 compares an average volume level of audio signals which are introduced into the first microphone 130-1 during the noise generation interval with a reference level.

When the volume level of the audio signal which is introduced into the first microphone is greater than the reference level, the electronic device determines that its user may not recognize a zoom noise by the audio signal. Accordingly, the electronic device proceeds to step 813 and determines whether the stereo recording is ended.

When the volume level of the audio signal which is introduced into the first microphone is less than or equal to the reference level, the electronic device proceeds to step 811 and sets the noise generation interval, where the volume level of the audio signal which is introduced into the first microphone is less than or equal to the reference level, to a noise cancellation interval for cancelling a noise.

Thereafter, the electronic device proceeds to step 813 and determines whether the stereo recording is ended.

When the stereo recording is not ended, the electronic device may returns to step 801 and performs a stereo recording using the plurality of microphones.

When the stereo recording is ended, the electronic device proceeds to step 815 and cancels a zoom noise by copying an audio signal which is introduced into the second microphone during one or more noise cancellation intervals generated in the stereo recording into an audio signal of the first microphone which is influenced by the zoom noise.

Thereafter, the electronic device ends the procedure of FIG. 8.

In the above-described embodiment of the present invention, the electronic device cancels the zoom noise selectively in consideration of the volume level of the audio signal which is introduced into the first microphone which is influenced by the zoom noise.

In another embodiment of the present invention, the electronic device cancels a zoom noise selectively in consideration of volume levels of audio signals which are introduced into the plurality of microphones.

In the above-described embodiment of the present invention, the electronic device cancels the zoom noise selectively by comparing the volume level of the audio signal which is introduced into the first microphone which is influenced by the zoom noise with the reference level.

In another embodiment of the present invention, the electronic device cancels a zoom noise selectively in consideration of information about the interval where the volume level of the audio signal which is introduced into the first microphone during the noise generation interval is greater than the reference level.

It will be appreciated that embodiments of the present invention according to the claims and description in this specification can be realized in the form of hardware, software or a combination of hardware and software.

Any such software may be stored in a computer readable storage medium. The computer readable storage medium stores one or more programs (software modules), the one or more programs comprising instructions, which when executed by one or more processors in an electronic device, cause the electronic device to perform a method of the present invention.

Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape or the like. It will be appreciated that the storage devices and storage media are embodiments of machine-readable storage that are suitable for storing a program or programs comprising instructions that, when executed, implement embodiments of the present invention.

Accordingly, embodiments provide a program comprising code for implementing apparatus or a method as claimed in any one of the claims of this specification and a machine-readable storage storing such a program. Still further, such programs may be conveyed electronically via any medium such as a communication signal carried over a wired or wireless connection and embodiments suitably encompass the same.

As described above, the electronic device including the plurality of microphones may prevent loss of the audio signal by the noise generated by the driving body by cancelling the noise by the driving body, which is introduced into at least the one microphone.

While the present invention has been particularly shown and described with reference to embodiments thereof, it will be understood by those skilled in the art that various changes in form and details may be made therein without departing from the spirit and scope of the present invention as defined by the appended claims and their equivalents.

What is claimed is:

1. A method in an electronic device, the method comprising:

stereo recording audio signals using a plurality of microphones;

identifying a noise generation interval, where the noise is generated by the electronic device itself; and replacing an audio signal which is recorder by one or more microphones which are influenced by the generated noise, during the noise generation interval with an audio signal which is recorded by a remaining microphone of the plurality of microphones during the noise generation interval.

2. The method of claim 1, wherein identifying the noise generation interval comprises determining a driving interval of one or more driving bodies of the electronic device as the noise generation interval.

3. The method of claim 2, wherein the one or more driving bodies includes a zoom lens.

4. The method of claim 1, further comprising:

determining whether the one or more microphones record noise above a predetermined level during the noise generation interval, wherein the audio signal which is recorded by the one or more microphones during the noise generation interval is replaced by the audio signal which is recorded by the remaining microphone during the noise generation interval in response to determining the one or more microphones record noise above the predetermined level during the noise generation interval.

5. The method of claim 4, wherein determining whether the one or more microphones record noise above the predetermined level comprises:

determining whether an average volume level of audio signals which are recorded by the one or more microphones during the noise generation interval was above the predetermined level.

6. The method of claim 1, wherein determining whether the one or more microphones record noise above the predetermined level comprises:

determining whether a volume level of an audio signal which recorded by the one or more microphones during the noise generation interval is greater than the predetermined level for over a predetermined length of time.

7. An electronic device comprising:

a plurality of microphones; and a processor operatively coupled to the plurality of microphones, wherein the processor is configured to:

stereo record audio signals using the plurality of microphones;

identify a noise generation interval, where the noise is generated by the electronic device itself; and replace an audio signal which is recorded by one or more microphones which are influenced by the generated noise, during the noise generation interval with an audio signal which is recorded by a remaining microphone of the plurality of microphones during the noise generation interval.

8. The electronic device of claim 7, further comprising, one or more driving bodies, wherein the processor is configured to identify a driving interval of the one or more driving bodies as the noise generation interval.

9. The electronic device of claim 8, wherein the one or more driving bodies includes a zoom lens.

10. The electronic device of claim 9, wherein the one or more microphones are adjacent to at least one of the one or more driving bodies and are influenced by a noise generated by the adjacent at least one of the one or more driving bodies.

11. The electronic device of claim 7, wherein the processor is configured to determine whether the one or more microphones record noise above a predetermined level during the noise generation interval using volume levels of audio signals which are recorded by the one or more microphones during the noise generation interval.

12. The electronic device of claim 7, wherein the processor is configured to determine whether the one or more microphones record noise above a predetermined level during the noise generation interval using an average volume level of audio signals which are recorded by the one or more microphones during the noise generation interval.

13. The electronic device of claim 7, wherein the processor is configured to determine whether the one or more microphones record noise above a predetermined level during the noise generation interval by determining whether a volume level of an audio signal which recorded by the one or more microphones during the noise generation interval is greater than the predetermined level for over a predetermined length of time.

14. The electronic device of claim 7, wherein the one or more microphones and the remaining microphone are located in both side surfaces or both sides of a front surface of the electronic device.

15. A method of an electronic device, comprising:

stereo recording audio signals using a plurality of microphones;

identifying a noise generation interval, where the noise is generated by the electronic device itself;

during the identified noise generation interval, inactivating one or more specific microphones of the plurality of microphones; and replacing an inactivated section recorded by the one or more specific microphones during the noise generation interval with a section of an audio signal recorded by one or more microphones of the plurality of microphones which were active during the identified noise generation interval.

* * * * *